US005353623A

United States Patent [19]

Bobenhausen

[11] Patent Number: 5,353,623

[45] Date of Patent: Oct. 11, 1994

[54] PORTABLE ELASTOMERIC HOSE CRIMPING TOOL

[76] Inventor: Larry F. Bobenhausen, 7117 Date Palm Ave., S., St. Petersburg, Fla. 33707-2013

[21] Appl. No.: 228,412

[22] Filed: Apr. 15, 1994

[51] Int. Cl.[5] ..... B21D 41/00

[52] U.S. Cl. ..... 72/402; 29/237; 72/416

[58] Field of Search ..... 29/282, 234, 237, 517, 29/515; 72/402, 416, 410, 412, 415; 269/126, 127

[56] References Cited

U.S. PATENT DOCUMENTS

| | | | |
|---|---|---|---|
| 3,019,320 | 2/1962 | Woolley . | |
| 3,731,518 | 5/1973 | Blocher | 29/237 |
| 3,736,788 | 6/1973 | Olive-Jones | 29/237 |
| 3,848,451 | 11/1974 | Allin | 29/237 |
| 4,891,877 | 1/1990 | Talavera | 29/237 |
| 4,978,100 | 12/1990 | Peurifoy | 269/127 |
| 5,257,525 | 11/1993 | Clarke | 29/237 |

OTHER PUBLICATIONS

ATCO "Model 3700 Portable Bubble Style Hose Crimper" May 1993.

*Primary Examiner*—Robert C. Watson
*Attorney, Agent, or Firm*—James E. Larson

[57] ABSTRACT

A portable tool for crimping a ferrel portion of a tube fitting around a hose is provided. The tool has an upper and lower frame. The upper frame has a means for stabilizing an upper die carrier which encloses an upper die insert. The lower frame encloses a lower die insert. A compression shaft is inserted through an aperture formed in the upper frame for moving the upper die carrier along a vertical axis of the tool. A means for pivoting the upper frame in relation to the lower frame is provided to allow a user to open and close the tool. A locking means is further provided permitting the upper frame to be locked to the lower frame during a crimping procedure. The compression shaft can be actuated manually, electrically, or hydraulically. The tool may further be set into a framed housing for use in a manufacturing environment.

20 Claims, 4 Drawing Sheets

PORTABLE ELASTOMERIC HOSE CRIMPING TOOL

BACKGROUND OF THE INVENTION

1 . Field of the Invention

This invention relates to hose crimping devices. More particularly, it relates to a portable tool for crimping a ferrell portion of a tube fitting around an elastomeric hose.

2. Description of Prior Art

Pipe and hose crimping devices are known in the prior art. Most of these devices are large, stationary machines used in manufacturing facilities. There is a need for a portable crimping device for use in the field to allow greater flexibility of use.

Attempts have been made to provide a portable crimping device as shown in U.S. Pat. No. 3,019,520 to Woolley. U.S. Pat. No. 3,019,520 describes a pipe crimping apparatus having a fixed annular split die and a moveable annular fixed die. There are means for pivotally securing the split sections of the fixed die together and the split sections of the moveable die together. A plurality of hydraulic jacks fasten the fixed and moveable dies together. A source of hydraulic fluid under pressure simultaneously operates the jacks to move the moveable die toward the fixed die whereby the moveable die progressively moves over a bell portion of a pipe end. As the moveable die moves closer to the fixed die, the diameter of the bell portion is slowly diminished around an inserted pipe end portion having a lesser diameter than the bell portion. When the moveable and fixed dies are almost abutting the apparatus has crimped the pipes together.

The apparatus shown in U.S. Pat. No. 3,019,520 has not provided adequate crimping results. The movement of the moveable die over the bell portion does not crimp the bell portion equally throughout. Further, the apparatus of U.S. Pat. No. 3,109,520 employs numerous separate parts, thereby causing additional manufacturing costs and time consuming attachment by an individual in the field. There is a need for a self-contained crimping apparatus providing equal crimping of a bell portion around an inserted pipe or hose.

A product marketed by ATCO attempted to provide a self-contained portable crimping device, Model 3700 Portable Bubble Style Hose Crimper. Model 3700 has an upper and lower frame enclosing die inserts. The upper frame moves vertically along a pair of aluminum rods located at opposed left and right sides. The rods are inserted through a pair of opposed integral cylinder channels at the left and right sides of the upper and lower frame. A compression shaft inserted through a top housing engages a die carrier enclosed within the upper frame to compress the die inserts together. A preassembled tube fitting having a ferrel portion attached to a hose for crimping around a tube is inserted into a throat of Model 3700 prior to compressing the die inserts.

Because the upper frame of Model 3700 has an upward limit and is not provided with a means to pivotly move the upper frame in relation to the lower frame, it would not be practical to use Model 3700 with a pipe or tube along a line of piping. Model 3700 does have a plate at a bottom portion of the lower frame which is removable allowing the lower frame to be removed from the device. Because Model 3700 does not have a stop means on the compression shaft, it is possible to over-pressurize the device forcing the bottom plate to pop off whereby the lower frame drops from the device. This over-pressurizing can cause the crimping procedure to fail and is potentially dangerous. Further, there is no means for locking the upper frame to the lower frame. Without the locking means, the Model 3700 can cause inadequate crimping results. Still further, the Model 3700 does not provide a portion on the device which allows a user to clamp it to a vice. It is most practicable to use a portable crimper by inserting it into a vice.

There is a need for an improved portable crimping device that provides a means for locking the upper frame to the lower frame and a means for pivotally swinging the upper frame away from the lower frame to crimp a wide selection of tube fittings and the like. It would be advantageous to provide a stabilizing means for an upper die carrier within an upper frame of the device to provide accurate vertical movement of the upper die carrier within the upper frame.

SUMMARY OF THE INVENTION

I have invented an improved portable crimping tool for use with tube fittings and the like. My tool has an upper and lower frame, the upper frame enclosing an upper die carrier. The upper die carrier has a stabilizing means for providing accurate vertical movement of the die carrier along a vertical axis of the tool. The upper die carrier encloses an upper die insert compressible against a lower die insert. The two die inserts crimp a ferrel portion or other similar fitting when inserted between the upper and lower die inserts.

A compression shaft inserts through an aperture formed in a middle portion of the upper frame and engages the upper die carrier in a top surface of the die carrier. The compression shaft can be actuated by a manual means through the use of a wrench or similar tool, or actuated by an electrical drive means or hydraulic drive means. The electrical and hydraulic drive means incorporates inserting the portable crimping tool into a housing. My improved device provides an extended portion on the lower frame which allows easy insertion into a vice for use in a crimping procedure.

A pivot means is provided allowing the upper frame to pivot away from the lower frame. Further, a locking means is provided to lock the upper frame to the lower frame during a crimping procedure.

BRIEF DESCRIPTION OF THE DRAWINGS

The invention may be best understood by those having ordinary skill in the art by reference to the following detailed description when considered in conjunction with the accompanying drawings in which.

DETAILED DESCRIPTION OF THE INVENTION

Figure 1:
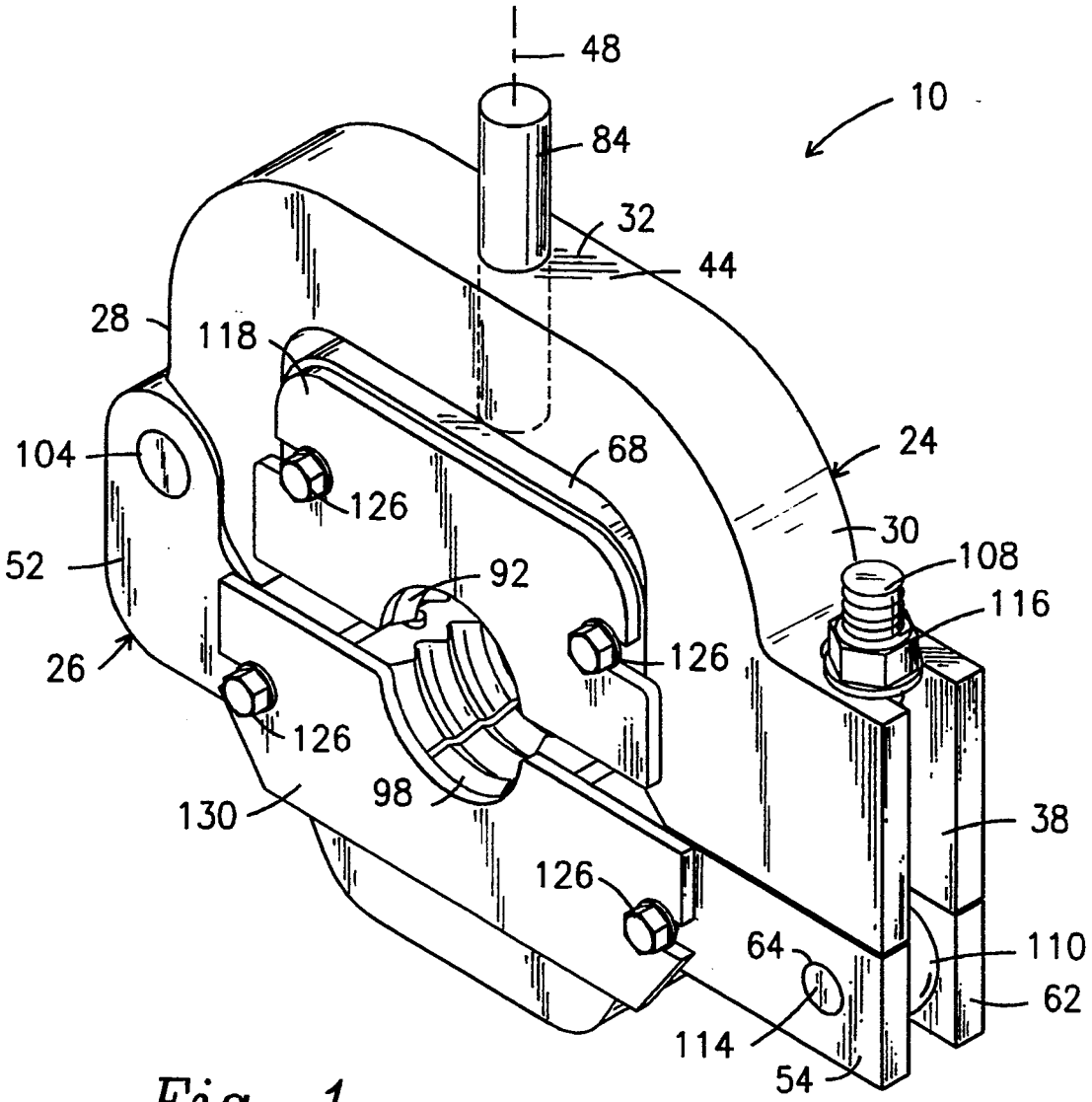
FIG. 1 is a perspective view of the portable elastomeric hose crimping tool of the present invention.

Throughout the following detailed description, the same reference numerals refer to the same elements in all figures.

A portable crimping tool 10 is shown in FIG. 1 for crimping a ferrel portion 12 attached to a hose 14 around an end 16 of a tube fitting 18. Although the tube fitting 18 shown in FIG. 2 has a fitting 20 and a tube portion 22, tube fittings of other configuration can be used with the portable crimping tool 10 of the present invention to crimp a ferrel portion or other similar crimpable portion.

Figure 5:
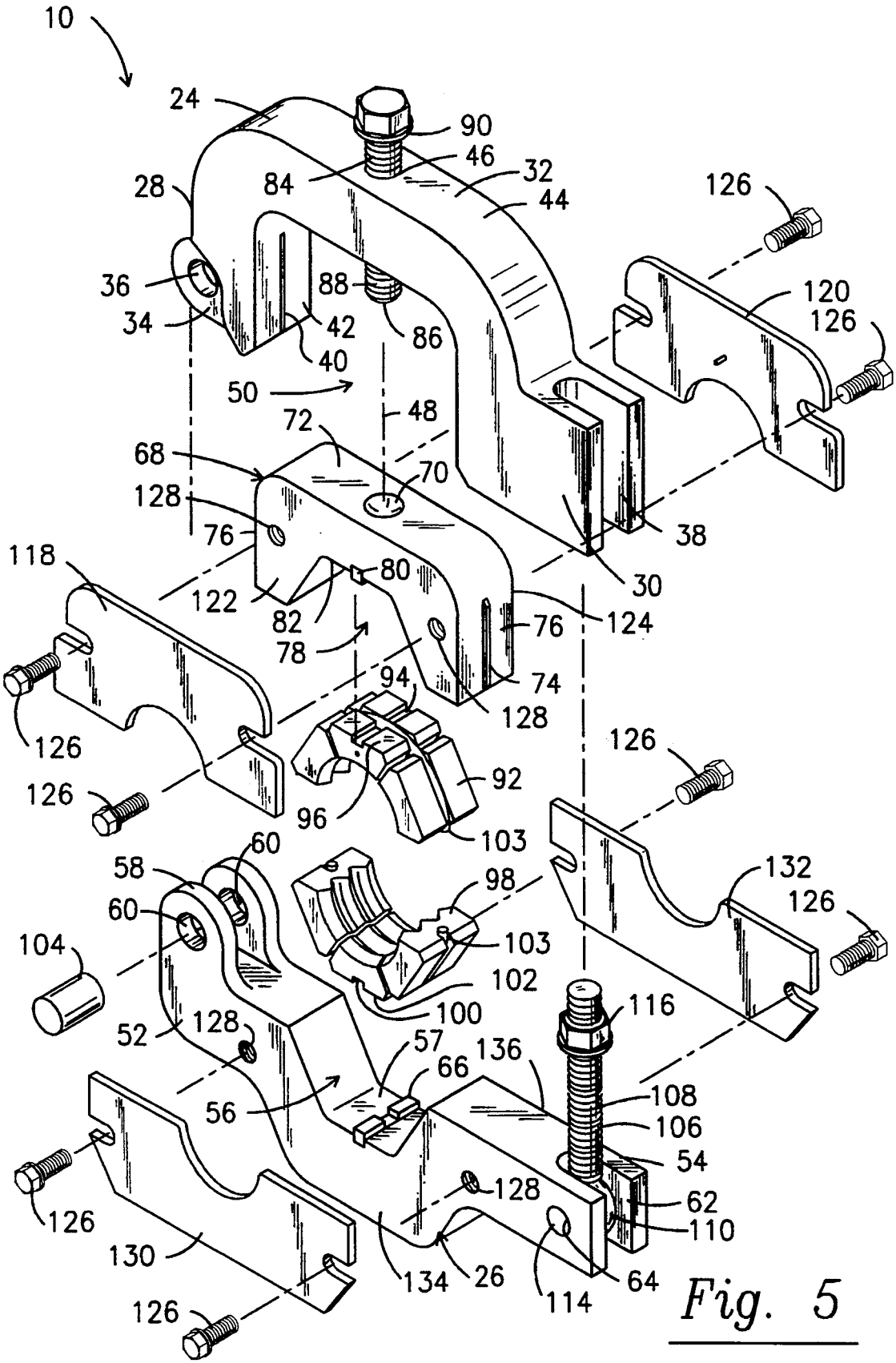
FIG. 5 is an exploded perspective view of the portable elastomeric hose crimping tool.

Referring to FIG. 5, the portable crimping tool 10 has an upper and lower frame 24 and 26 respectively. Upper frame 24 has opposed first left and right side portions 28 and 30 respectively and a middle portion 32 intermediate first left and right side portions 28 and 30. A pivot pin alignment member 34 is located at first left side portion 28 with an alignment aperture 36 formed in pivot pin alignment member 34. An upper U-bracket 38 is located at first right side portion 30 and a pair of opposed guide channels 40 are located along opposed inner side walls 42 of first left and right side portions 28 and 30. A top surface 44 of upper frame 24 has a compression shaft aperture 46 formed through middle portion 32 defining a vertical axis 48 of portable crimping tool 10. A first cavity 50 is located below middle portion 32 intermediate first left and right side portions 28 and 30. Guide channels 40 parallel vertical axis 48.

Figure 3:
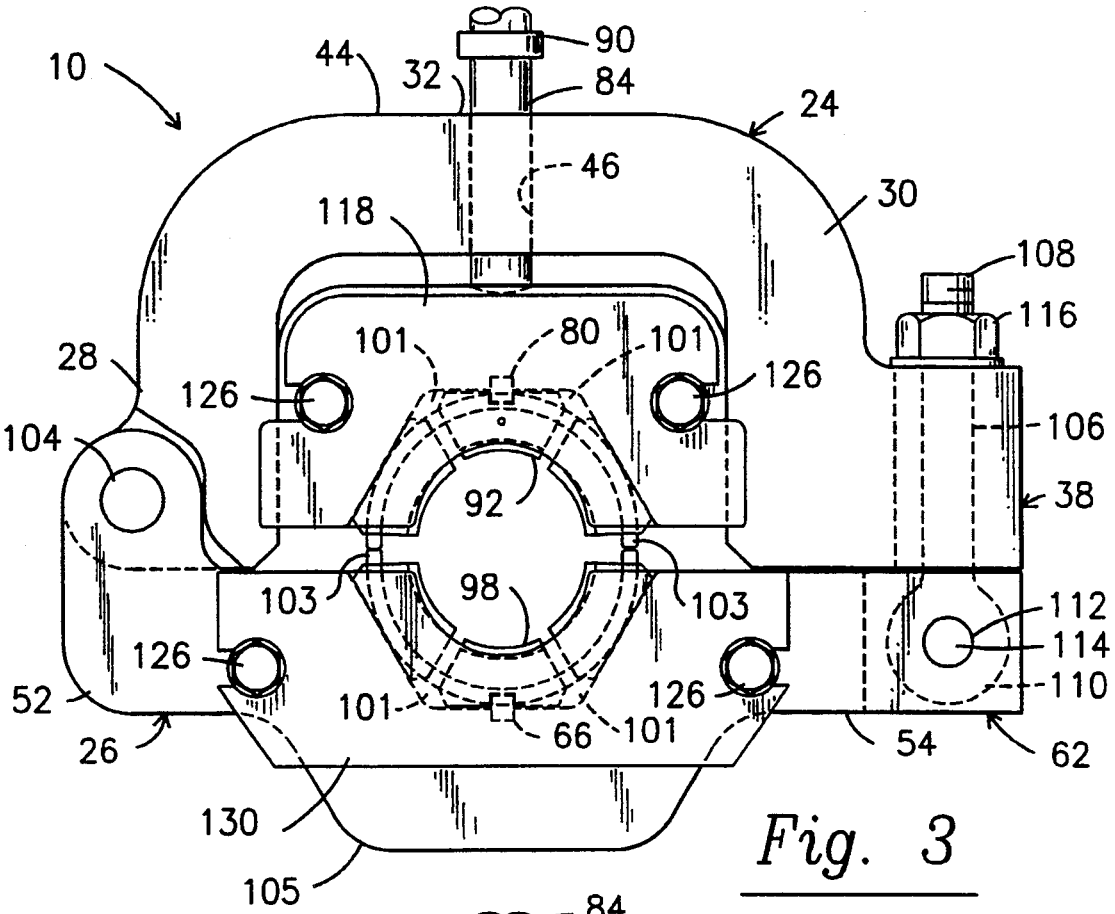
FIG. 3 is a front view of the portable elastomeric hose crimping tool in a relaxed state.
Figure 4:
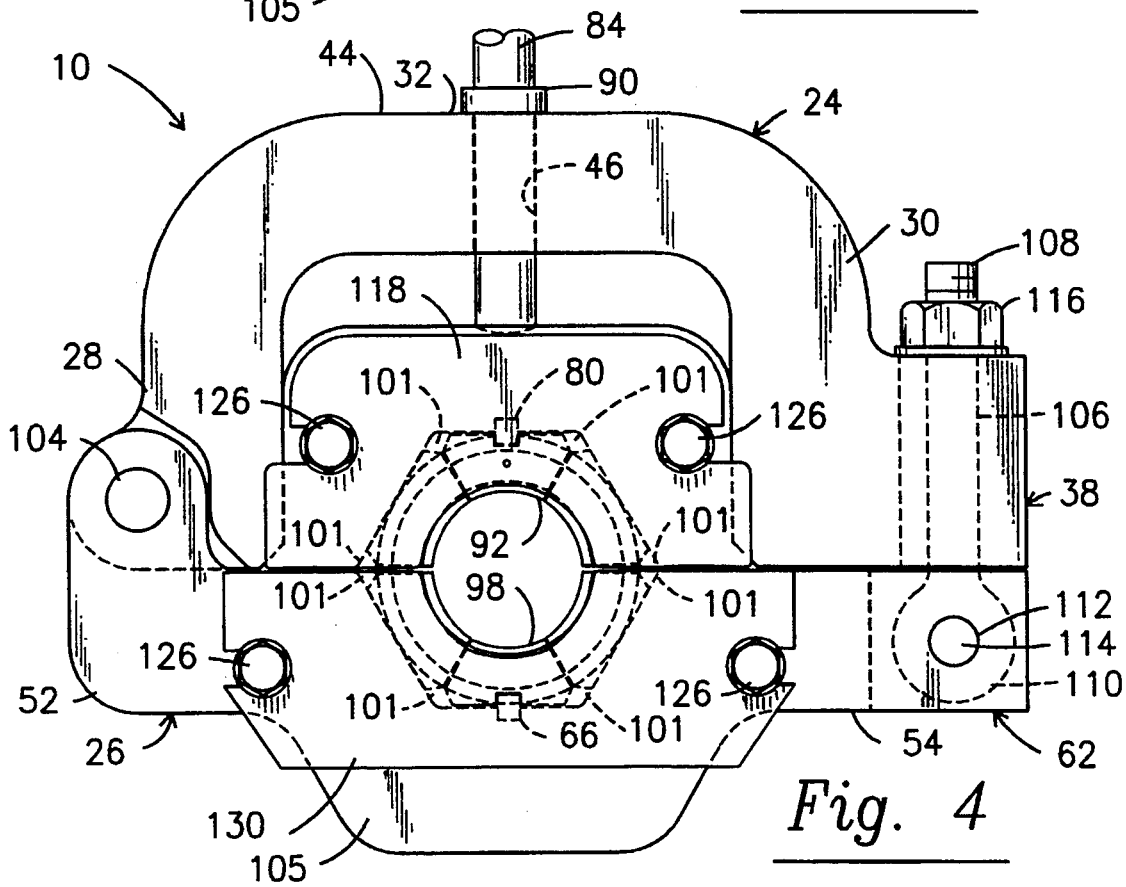
FIG. 4 is a front view of the portable elastomeric hose crimping tool in a compressed state.

Referring to FIG. 5, lower frame 26 has opposed second left and right side portions 52 and 54 respectively and a trough 56 located intermediate second left and right side portions 52 and 54. A pivot pin bracket 58 is located at second left side portion 52 with a pair of pivot pin apertures 60 formed in pivot pin bracket 58. A lower U-bracket 62 is located at second right side portion 54 with a pair of swivel pin apertures 64 formed in lower U-bracket 62. An integral lower key 66 is transversely positioned in trough 56 integral with a floor surface 57 of trough 56. Referring to FIGS. 3 and 4, lower frame 26 has an extended bottom portion 105 allowing tool 10 to be insert and secured into a vice (not shown).

Referring to FIG. 5, an upper die carrier 68 has a concave depression 70 formed in a top surface 72 of upper die carrier 68. A pair of opposed guide rails 74 are located along opposed outer side walls 76 of upper die carrier 68 for engagement with guide channels 40 of upper frame 24 allowing movement of upper die carrier along vertical axis 48 within first cavity 50 of upper frame 24. A second cavity 78 is located below concave depression 70. An upper key 80 is transversely positioned within second cavity 78 integral along an inner top surface 82 of upper die carrier 68. The first cavity 50 of upper frame 24 receives upper die carrier 68 such that concave depression 70 is axially aligned with compression shaft aperture 46. A compression shaft 84 having a convex protuberance 86 and threads 88 is inserted through compression shaft aperture 46 whereby concave depression 70 receives convex protuberance 86. Axial downward movement of compression shaft 84 thereafter moves upper die carrier 68 downwardly. Guide rails 74 in communication with guide channels 40 provide vertical movement of upper die carrier 68 along vertical axis 48.

Compression shaft 84 has a shoulder portion 90 distal from convex protuberance 86 for abutting top surface 44 of upper frame 24 providing a lower limit for compression shaft 84 to reach. In the preferred embodiment, shown in FIG. 5, compression shaft 84 is a threaded shoulder bolt inserted through compression shaft aperture 46, actuated by a manual means through the use of a wrench (not shown) or other similar tool. Compression shafts of other configuration, actuated by other means, can be employed with the present invention.

Referring to FIG. 5, an upper die insert 92 having a first key-way 94 transversely formed at an apex 96 of upper die insert 92 is inserted into second cavity 78 of upper die carrier 68. First key-way 94 receives upper key 80 of upper die carrier 68, locating upper die insert 92 within second cavity 78 so that upper die insert 92 is moveable along vertical axis 48 in communication with upper die carrier 68. A lower die insert 98 having a second key-way 100 transversely formed at a bottom surface 102 of lower die insert 98 is inserted into trough 56 of lower frame 26. Second key-way 100 receives lower key 66 of lower frame 26, locating lower die insert 98 within trough 56.

Referring to FIG. 5, pivot pin alignment member 34 of upper frame 24 is inserted into pivot pin bracket 58 of lower frame 26 such that the pair of pivot pin apertures 60 formed in pivot pin bracket 58 are axially aligned with alignment aperture 36 of pivot pin alignment member 34. A pivot pin 104 is axially inserted through pivot pin apertures 60 and alignment aperture 36 pivotly attaching upper frame 24 to lower frame 26.

An eye bolt 106 having a threaded shaft 108 and a head portion 110 is provided as shown in FIGS. 1, 3, 4, and 5. Head portion 110, having a bolt aperture 112 formed therein, as shown in FIGS. 3 and 4, is inserted into lower U-bracket 62 such that bolt aperture 112 of eye bolt 106 is axially aligned with the pair of swivel pin apertures 64 of lower U-bracket 62. A swivel pin 114 is axially inserted through swivel pin apertures 64 and bolt aperture 112, rotatably attaching head portion 110 of eye bolt 106 to lower frame 26. A locking nut 116 engages threaded shaft 108 of eye bolt 106 for locking upper frame 24 to lower frame 26 when threaded shaft 108 extends upwardly, parallel to vertical axis 48, through upper U-bracket 38.

Referring to FIG. 5, opposed upper front and rear covers, 118 and 120 respectively, enclose upper die insert 92 within second cavity 78 of upper die carrier 68. Upper front and rear covers 118 and 120 are removeably attached to opposed upper front and rear walls, 122 and 124 respectively, of upper die carrier 68 by a plurality of bolts 126. A plurality of threaded bores 128 are formed in upper front and rear walls 122 and 124 of upper die carrier 68 for receiving bolts 126. Opposed lower front and rear covers, 130 and 132 respectively, enclose lower die insert 98 within trough 56 of lower frame 26. Lower front and rear covers 130 and 132 are removeably attached to opposed lower front and rear walls, 134 and 136 respectively, of lower frame 26 by bolts 126. Threaded bores 128 are formed in lower front and rear walls 134 and 136 of lower frame 26 for receiving bolts 126.

Figure 2:
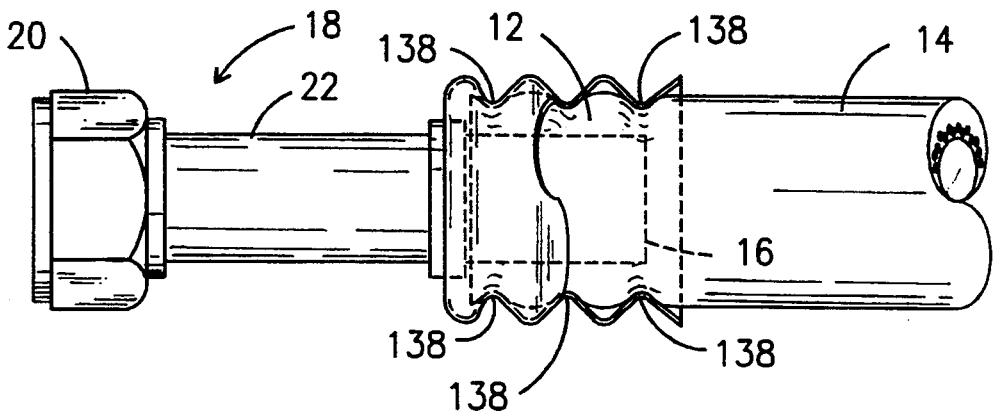
FIG. 2 a side view of a tube fitting wherein an end portion of a tube fitting is inserted into an elastomeric hose and a ferrel portion crimped around the elastomeric hose by the portable elastomeric hose crimping tool of the present invention.

To use portable crimping tool 10, tube fitting 18 having end 16 inserted into hose 14 having a ferrel portion 12 attached to hose 14 is inserted into an unlocked crimping tool 10 such that ferrel portion 14 is transversely positioned across lower die insert 98. Upper frame 24 is pivotly rotated until upper U-bracket 38 abuts lower U-bracket 62 thereby enclosing ferrel portion 12. Eye bolt 106 is swiveled upwardly permitting locking nut 116 to lock upper frame 24 to lower frame 26. Compression shaft 84 is actuated downwardly along vertical axis 48, compressing upper and lower die inserts 92 and 98 around ferrel portion 12. When shoulder portion 90 of compression shaft 84 abuts top surface 44 of upper frame 24, ferrel portion 12 has been successfully crimped providing a sealed hose fitting, as shown in FIG. 2. The crimped fitting provides a means for transferring liquids and gases from hose 14 to tube 22 and onward to a user desired location. A wide selection of hose 14 can be used with portable crimping tool 10. Although FIG. 2 shows a barrier hose being employed, a conventional non-barrier hose can be used. To adequately crimp the ferrel portion 12, 6000 psi is applied.

As shown in FIGS. 3 and 4, a multiplicity of air gaps 101 are provided between upper die insert 92 and upper die carrier 68 and between lower die insert 98 and lower frame 26. Air gaps 101 provide space for upper and lower die inserts 92 and 98 to spread out from a generally circular shape to a generally oval shape and back to a generally circular shape during the crimping procedure due to an increase in pressure applied upon upper and lower die inserts 92 and 98. As shown in FIGS. 3 and 5, an elastomeric impact absorbing filler 103 in upper and lower die inserts 92 and 98 permit upper and lower die inserts 92 and 98 to change shape while retaining their integrity.

As shown in FIG. 2, the preferred form of the crimped ferrel portion 12 has three finger channels 138 on the crimped ferrel portion 12. Upper and lower die inserts 92 and 98 of varying configuration can be employed with crimping tool 10 to provide crimped ferrel portions 12 of varying configuration.

Figure 7:
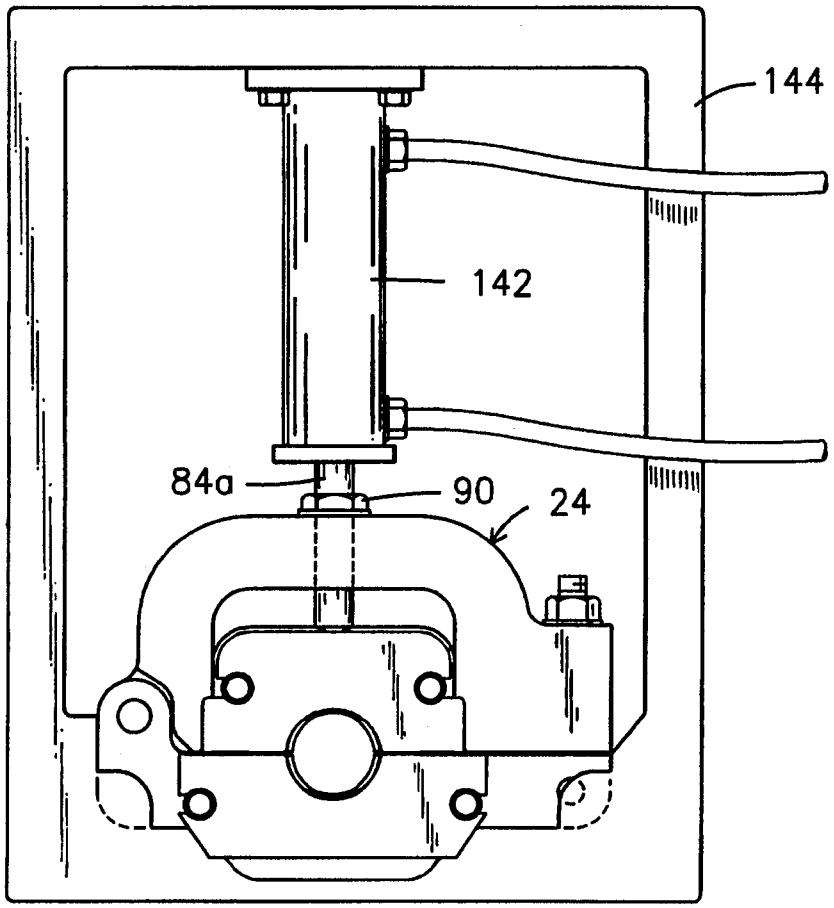
FIG. 7 is the portable elastomeric hose crimping tool mounted in a frame having a compression shaft actuated by a hydraulic means.
Figure 6:
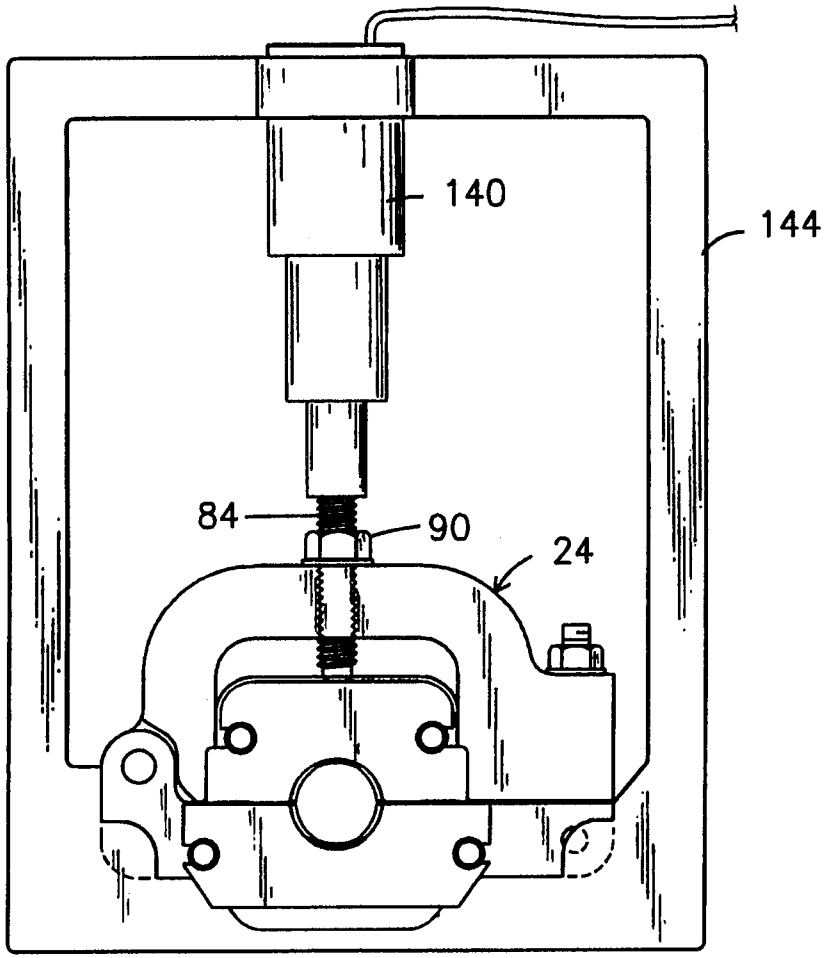
FIG. 6 is the portable elastomeric hose crimping tool mounted in a frame having a compression shaft actuated by an electrical means.

Referring to FIG. 6, compression shaft 84 of portable crimping tool 10 can be actuated by an electrical drive means 140 in a first alternate embodiment. The electrical drive means 140 could be either a direct current or alternating current motor. Still further, as shown in FIG. 7, a compression shaft **84*a* of crimping tool 10 can be actuated by a hydraulic drive means 142 in a second alternate embodiment. Both alternate embodiments employ a housing 144 for removeably receiving lower frame 26 of portable crimping tool 10. Compression shaft 84*a* used with hydraulic drive means 142** is not threaded.

In the preferred embodiment, upper and lower frames 24 and 26, upper die carrier 68, covers 118, 120, 130, and 132, eye bolt 106, locking nut 116, pivot pin 104, swivel pin 114, bolts 126, and upper and lower die inserts 92 and 98 are made of steel. Elastomeric impact absorbing material filler 103 is made of polyurethane.

Equivalent elements can be substituted for the elements employed in this invention to obtain the same results in the same way.

Having thus described the invention what is claimed and desired to be secured by Letters Patent is:

1. A portable tool for crimping a ferrel portion of a tube fitting around an end portion of an elastomeric hose, the tool comprising, an upper frame having opposed first left and right side portions, a middle portion, a top surface, a first cavity located below the middle portion and intermediate the first left and right side portions, and a compression shaft aperture formed through the middle portion, the compression shaft aperture defining a vertical axis of the tool, a lower frame having opposed second left and right side portions and a trough located intermediate the second left and right side portions, an upper die carrier having a depression formed in a top surface and a second cavity located below the depression, the upper die carrier moveable within the first cavity of the upper frame along the vertical axis, the depression axially aligned with the compression shaft aperture, an upper die insert positioned within the second cavity of the upper die carrier and moveable along the vertical axis of the tool in communication with the upper die carrier, a lower die insert positioned within the trough of the lower frame, a compression shaft having a lower end and a shoulder portion located at an upper end, the compression shaft inserted through the compression shaft aperture such that the lower end engages the depression formed in the top surface of the upper die carrier for moving the upper die carrier along the vertical axis within the first cavity of the upper frame, the shoulder portion abutting the top surface of the upper frame when the compression shaft has reached a lower limit, means for locating the upper die insert within the second cavity of the upper die carrier, means for locating the lower die insert within the trough of the lower frame, means for stabilizing the upper die carrier within the first cavity of the upper frame, means for pivoting the upper frame in relation to the lower frame, and means for locking the upper frame to the lower frame.

2. The portable tool according to claim 1, wherein the means for locating the upper die insert within the second cavity of the upper die carrier is an upper key transversely positioned within the second cavity of the upper die carrier integral with an inner top wall and engaging a first key-way formed at an apex of the upper die insert.

3. The portable tool according to claim 1, wherein the means for locating the lower die insert within the trough of the lower die carrier is a lower key transversely positioned within the trough of the lower frame integral with a floor surface and engaging a second key-way formed at a bottom surface of the lower die insert.

4. The portable tool according to claim 1, wherein the means for stabilizing the upper die carrier within the first cavity of the upper frame is a pair of opposed guide channels formed along opposed inner side walls of the first left and right side portions of the upper frame, the guide channels receiving a pair of opposed guide rails located along opposed outer side walls of the upper die carrier, the guide channels and guide rails positioned parallel to the vertical axis of the tool.

5. The portable tool according to claim 1, wherein the means for pivoting the upper frame in relation to the lower frame is a pivot pin bracket located at the second left side portion of the lower frame having a pair of pivot pin apertures formed therein receiving a pivot pin alignment member located at the first left side portion of the upper frame having an alignment aperture formed therein such that the pivot pin apertures of the pivot pin bracket are axially aligned with the alignment aperture of the alignment member and a pivot pin inserting through the pivot pin apertures and alignment aperture.

6. The portable tool according to claim 1, wherein the means for locking the upper frame to the lower frame is an eye bolt having a threaded shaft and a head portion, the head portion rotatably attached to a lower U-bracket located at a second right side portion of the lower frame, the threaded shaft of the eye bolt extending upwardly and parallel to the vertical axis of the tool through an upper U-bracket located at the second right side portion of the upper frame, and a locking nut engaging the threaded shaft of the eye bolt wherein the nut abuts the upper U-bracket when the upper frame is locked to the lower frame.

7. The portable tool according to claim 1, wherein the compression shaft is threaded and engages threads within the compression shaft aperture formed in the upper frame, the compression shaft actuated manually.

8. The portable tool according to claim 1, wherein the tool is set within a framed housing.

9. The portable tool according to claim 8, wherein the compression shaft is threaded and engages threads within the compression shaft aperture formed in the upper frame, the compression shaft actuated by an electrical drive means mounted to the framed housing.

10. The portable tool according to claim 8, wherein the compression shaft is actuated by a hydraulic drive means mounted to the framed housing.

11. A portable tool for crimping a ferrel portion of a tube fitting around an end portion of an elastomeric hose, the tool comprising, an upper frame having opposed first left and right side portions, a middle portion, a first cavity located below the middle portion and intermediate the first left and right side portions, a pivot pin alignment member located at the first left side portion and having an alignment aperture formed therein, an upper U-bracket located at the first right side portion, a top surface, and a compression shaft aperture formed through the middle portion, the compression shaft aperture defining a vertical axis of the tool, a lower frame having opposed second left and right side portions, a trough located intermediate the second left and right side portions, a pivot pin bracket located at the second left side portion and having a pair of pivot pin apertures formed therein, a lower U-bracket located at the second right side portion and having a pair of swivel pin apertures formed therein, and a lower key transversely positioned in the trough integral with a floor surface of the trough, an upper die carrier having a concave depression formed in a top surface axially aligned with the compression shaft aperture of the upper frame, a second cavity positioned below the concave depression, an upper key transversely positioned within the second cavity integral along an inner top wall, the upper die carrier moveable within the first cavity of the upper frame along the vertical axis, an upper die insert having a first key-way transversely formed at an apex of the upper die insert, the first key-way receiving the upper key for locating the upper die insert within the second cavity, the upper die insert moveable along the vertical axis in communication with the upper die carrier, a lower die insert having a second key-way transversely formed at a bottom surface of the lower die insert, the second key-way receiving the lower key for locating the lower die insert within the trough of the lower frame, the pivot pin alignment member of the upper frame inserted into the pivot pin bracket of the lower frame axially aligning the pair of pivot pin apertures formed in the pivot pin bracket with the alignment aperture of the pivot pin alignment member, a pivot pin axially inserted through the pivot pin apertures and the alignment aperture for pivotly attaching the upper frame to the lower frame, an eye bolt having a threaded shaft and a head portion, the head portion having a bolt aperture formed therein, the head portion inserted into the lower U-bracket such that the bolt aperture is axially aligned with the pair of swivel pin apertures of the lower U-bracket, a swivel pin axially inserted through the pair of swivel pin apertures and bolt aperture for rotatably attaching the head portion of the eye bolt to the lower frame, a locking nut engaging the threaded shaft of the eye bolt for locking the upper frame to the lower frame when the threaded shaft extends upwardly and parallel to the vertical axis of the tool through the upper U-bracket, a compression shaft having a convex protuberance at a lower end and a shoulder portion at an upper end, the compression shaft inserted through the shaft aperture of the upper frame such that the convex protuberance engages the concave depression of the upper die carrier for moving the upper die carrier along the vertical axis of the tool, the shoulder portion abutting the top surface of the upper frame when the compression shaft has reached a lower limit, and means for stabilizing the upper die carrier within the first cavity of the upper frame.

12. The portable tool according to claim 11 further comprising, opposed upper front and rear covers for enclosing the upper die insert within the second cavity, the upper front and rear covers removeably attached to opposed front and rear walls of the upper die carrier by a plurality of bolts, a plurality of threaded bores formed in the front and rear walls of the upper die carrier for receiving the plurality of bolts, opposed lower front and rear covers for enclosing the lower die insert within the trough of the lower frame, the lower front and rear covers removeably attached to opposed front and rear walls of the lower frame by a plurality of bolts, and a plurality of threaded bores formed in the front and rear walls of the lower frame for receiving the plurality of bolts.

13. The portable tool according to claim 11, wherein the compression shaft is threaded and engages threads within the compression shaft aperture formed in the upper frame, the compression shaft actuated manually.

14. The portable tool according to claim 11, wherein the tool is set within a framed housing.

15. The portable tool according to claim 14, wherein the compression shaft is actuated by a drive means mounted to the framed housing.

16. A portable tool for crimping a ferrel portion of a tube fitting around an end portion of an elastomeric hose, the tool comprising, an upper frame having opposed first left and right side portions, a middle portion, a first cavity located below the middle portion and intermediate the first left and right side portions, a pivot pin alignment member located at the first left side portion and having an alignment aperture formed therein, an upper U-bracket located at the first right side portion, a pair of opposed guide channels located along opposed inner side walls of the first left and right side portions, a top surface, and a compression shaft aperture formed through the middle portion, the compression shaft aperture defining a vertical axis of the tool, the pair of guide channels parallel to the vertical axis, a lower frame having opposed second left and right side portions, a trough located intermediate the second left and right side portions, a pivot pin bracket located at the second left side portion and having a pair of pivot pin apertures formed therein, a lower U-bracket located at the second right side portion and having a pair of swivel pin apertures formed therein, and a lower key transversely positioned in the trough integral with a floor surface of the trough, an upper die carrier having a concave depression formed in a top surface axially aligned with the compression shaft aperture of the upper frame, a second cavity positioned below the concave depression, an upper key transversely positioned within the second cavity integral along an inner top wall, and a pair of opposed guide rails located along opposed outer side walls for engagement with the guide channels of the upper frame for moving the upper die carrier along the vertical axis within the first cavity of the upper frame, an upper die insert having a first key-way transversely formed at an apex of the upper die insert, the first key-way receiving the upper key for locating the upper die insert within the second cavity, the upper die insert moveable along the vertical axis in communication with the upper die carrier, a lower die insert having a second key-way transversely formed at a bottom surface of the lower die insert, the second key-way receiving the lower key for locating the lower die insert within the trough of the lower frame, the pivot pin alignment member of the upper frame inserted into the pivot pin bracket of the lower frame axially aligning the pair of pivot pin apertures with the alignment aperture, a pivot pin axially inserted through the pivot pin apertures and the alignment aperture for pivotly attaching the upper frame to the lower frame, an eye bolt having a threaded shaft and a head portion, the head portion having a bolt aperture formed therein, the head portion inserted into the lower U-bracket such that the bolt aperture is axially aligned with the pair of swivel pin apertures of the lower U-bracket, a swivel pin axially inserted through the pair of swivel pin apertures and bolt aperture for rotatably attaching the head portion of the eye bolt to the lower frame, a locking nut engaging the threaded shaft of the eye bolt for locking the upper frame to the lower frame when the threaded shaft extends upwardly and parallel to the vertical axis of the tool through the upper U-bracket, and a compression shaft having a convex protuberance at a lower end and a shoulder portion at an upper end, the compression shaft inserted through the shaft aperture of the upper frame such that the convex protuberance engages the concave depression of the upper die carrier for moving the upper die carrier along the vertical axis of the tool, the shoulder portion abutting the top surface of the upper frame when the compression shaft has reached a lower limit, opposed upper front and rear covers for enclosing the upper die insert within the second cavity, the upper front and rear covers removeably attached to opposed front and rear walls of the upper die carrier by a plurality of bolts, a plurality of threaded bores formed in the front and rear walls of the upper die carrier for receiving the plurality of bolts, opposed lower front and rear covers for enclosing the lower die insert within the trough of the lower frame, the lower front and rear covers removeably attached to opposed front and rear walls of the lower frame by a plurality of bolts, and a plurality of threaded bores formed in the front and rear walls of the lower frame for receiving the plurality of bolts.

17. The portable tool according to claim 16, wherein the compression shaft is threaded and engages threads within the compression shaft aperture formed in the upper frame, the compression shaft actuated manually.

18. The portable tool according to claim 16, wherein the tool is set within a framed housing.

19. The portable tool according to claim 18, wherein the compression shaft is threaded and engages threads within the compression shaft aperture formed in the upper frame, the compression shaft actuated by an electrical drive means mounted to the framed housing.

20. The portable tool according to claim 18, wherein the compression shaft is actuated by a hydraulic drive means mounted to the framed housing.

* * * * *